US010384210B2

(12) United States Patent
Shirai et al.

(10) Patent No.: US 10,384,210 B2
(45) Date of Patent: Aug. 20, 2019

(54) BREAKER LINER ATTACHMENT STRUCTURE FOR VERTICAL SHREDDER

(71) Applicant: KUBOTA ENVIRONMENTAL SERVICE CO., LTD., Tokyo (JP)

(72) Inventors: Atsuhiko Shirai, Kitakatsuragi-gun (JP); Katsuya Shibata, Osaka (JP)

(73) Assignee: KUBOTA ENVIRONMENTAL SERVICE CO., LTD., Tokyo (JP)

( * ) Notice: Subject to any disclaimer, the term of this patent is extended or adjusted under 35 U.S.C. 154(b) by 396 days.

(21) Appl. No.: 15/282,903

(22) Filed: Sep. 30, 2016

(65) Prior Publication Data

US 2017/0095820 A1 Apr. 6, 2017

(30) Foreign Application Priority Data

Oct. 2, 2015 (JP) ..... 2015-196800

(51) Int. Cl.

| | |
|---|---|
| ***B02C 13/18*** | (2006.01) |
| ***B02C 2/06*** | (2006.01) |
| ***B02C 13/28*** | (2006.01) |
| *B02C 13/282* | (2006.01) |

(52) U.S. Cl.

CPC ..... *B02C 13/18* (2013.01); *B02C 2/06* (2013.01); *B02C 13/2804* (2013.01); *B02C 2013/1871* (2013.01); *B02C 2013/2808* (2013.01); *B02C 2013/2825* (2013.01); *B02C 2210/02* (2013.01)

(58) Field of Classification Search

CPC ..... B02C 13/14; B02C 13/18; B02C 13/28; B02C 13/282; B02C 13/2804; B02C 2013/1871; B02C 2013/2825; B02C 2/06

USPC ..... 241/197, 209, 286

See application file for complete search history.

(56) References Cited

U.S. PATENT DOCUMENTS

| | | | | |
|---|---|---|---|---|
| 4,519,551 A * | 5/1985 | Ceurvorst | ..... | B02C 13/28 241/194 |
| 4,650,129 A * | 3/1987 | Newell | ..... | B02C 13/28 241/185.5 |
| 4,915,310 A * | 4/1990 | Stelk | ..... | B02C 13/28 241/194 |
| 10,219,451 B2 * | 3/2019 | Green | ..... | A01G 23/067 |

FOREIGN PATENT DOCUMENTS

| | | |
|---|---|---|
| DE | 7415738 U | 8/1974 |
| EP | 0607977 A2 | 7/1994 |
| EP | 0677328 A1 | 10/1995 |
| JP | 3059207 U | 7/1999 |

OTHER PUBLICATIONS

Feb. 23, 2017 Extended European Search Report issued in European Patent Application No. 16191125.0.

May 21, 2019 Office Action issued in Japanese Patent Application No. 2015-196800.

* cited by examiner

*Primary Examiner* — Kenneth E Peterson
*Assistant Examiner* — Nhat Chieu Q Do
(74) *Attorney, Agent, or Firm* — Oliff PLC

(57) ABSTRACT

A breaker liner attachment structure for a vertical shredder including a rotor, a cylindrical shell, and a breaker, includes: a void that has an opening on an upper side and formed in an area between breaker liners in the breaker; and bolt insertion holes formed to extend from inner walls of the void to side surfaces of the breaker. Bolts are inserted into the bolt insertion holes via attachment holes formed in the breaker liners. The bolts are fastened with nuts from a side of the inner walls of the void.

6 Claims, 6 Drawing Sheets

BREAKER LINER ATTACHMENT STRUCTURE FOR VERTICAL SHREDDER

CROSS-REFERENCE TO RELATED APPLICATIONS

The present application claims priority under 35 U.S.C. 119 to Japanese Patent Application No. 2015-196800 filed on Oct. 2, 2015, the contents of this application are incorporated herein by reference in their entirety.

BACKGROUND OF THE INVENTION

Field of the Invention

The present invention relates to a breaker liner attachment structure for a vertical shredder that shreds discarded household electric appliances and the like.

Description of the Related Art

Vertical shredders are used as devices that perform a shredding process for recycling discarded household electric appliances such as a refrigerator and/or massive waste such as pressed aluminum, steel rack, electronic board and radiator that have been collected.

The vertical shredder includes: a rotor that is supported on a rotation shaft rotating about a vertical axis; a cylindrical shell, that is disposed on an outer side of the rotor in a radial direction in such a mariner as to be concentric with the vertical axis, and has an inner circumference portion on which a shell liner is attached; a breaker that is supported above the rotor in such a manner as to be coaxial with a rotation shaft; a sweeper supported below the rotor in such a manner as to be coaxial with the rotation shaft; a discharge ring disposed on a circumference portion of the sweeper in such a manner as to extend along the rotational trajectory of the sweeper; and a discharge portion through which a shredded material that has been swept out through an opening formed on a circumference wall of the discharge ring by the sweeping operation performed by the sweeper is discharged to the outside.

Japanese Utility Model No. 3059207 (hereinafter, referred to as "Patent Literature 1") discloses a vertical shredder including a breaker (described as a "knocker" in Patent Literature 1), a rotor, and a sweeper that are rotatable about a vertical axis both in normal and reverse directions. In the vertical shredder, liners are attached to both left and right side surfaces of the breaker and the sweeper, serving as smashing surfaces.

The breaker liners disclosed in Patent Literature 1 are breaker liners disposed on both left and right side surfaces of portions of an arm, formed to extend in the radial direction, on a tip side, for the rotation in both normal and reverse directions about the vertical axis. This pair of breaker liners are fastened and fixed to each other through a long bolt and a nut, with the arm in between.

Thus, the bolt is largely elongated by the impact and the like as a result of smashing the shredding target object. As a result, the nut is likely to be loosened. All things considered, the breaker might be detached from the arm during the shredding process.

When the breaker liner wears and becomes thin by being in contact with the shredding target object during the shredding process, the bolt and the nut might also wear. In particular, the nut that has worn is difficult to remove when the breaker liner is replaced. Further wearing might even result in detachment of the breaker liner from the arm during the shredding process.

SUMMARY OF THE INVENTION

The present invention is made in view of the conventional problem described above and an object of the present invention is to provide a breaker liner attachment structure for a vertical shredder in which rotation in both normal and reverse direction can be performed. With the attachment structure, the liner can be appropriately replaced, and are prevented from accidentally detaching.

A breaker liner attachment structure for a vertical shredder according to an aspect of the present invention includes a rotor that is supported on a rotation shaft rotating about a vertical axis and includes a shredding mechanism, a cylindrical shell that is disposed on an outer side of the rotor in a radial direction in such a manner as to be concentric with the vertical axis, a breaker that is supported above the rotor in such a manner as to be coaxial with the rotation shaft, and breaker liners disposed opposite to each other in the breaker, characterized in that a void that has an opening on an upper side is formed in an area between the breaker liners in the breaker and bolt insertion holes are formed to extend from inner walls of the void to side surfaces of the breaker, and bolts are inserted into the bolt insertion holes via attachment holes formed in the breaker liners and are fastened with nuts from a side of the inner walls of the void.

Preferably, the void is formed in a center portion of the breaker in a width direction.

Preferably, a counter bore portion is formed on each of the attachment holes formed in the breaker liners and accommodates a head portion of a corresponding one of the bolts, and facing surfaces of the counter bore portion and the head portion of the bolt are provided with surface finishing to be smooth.

Preferably, a lid is provided to close the void, and a balance weight for adjusting rotation balance of the breaker is adjustable with weight of the lid.

Further aspects of the invention will be apparent by referring to an embodiment described below.

BRIEF DESCRIPTION OF THE DRAWINGS

Some embodiments of the present disclosure are shown by way of example, and not limitation, in the accompanying figures.

DETAILED DESCRIPTION OF THE EMBODIMENTS

A breaker liner attachment structure and a discharge portion liner attachment structure for a vertical shredder are described with reference to the drawings.

Figure 2A:
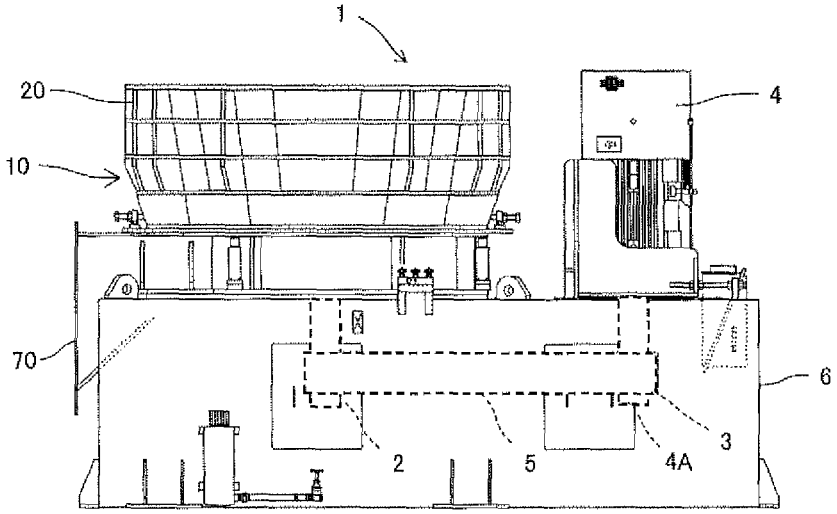
FIG. 2A is a front view of the vertical shredder.
Figure 2B:
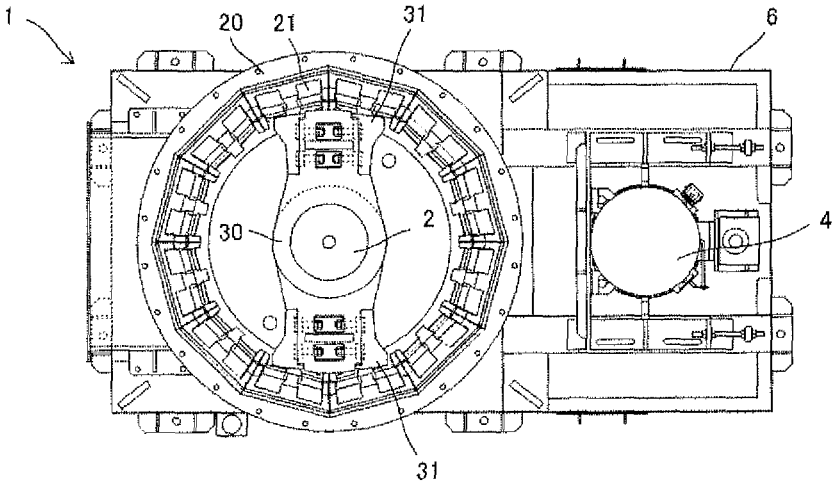
FIG. 2B is a plan view of the vertical shredder.
Figure 2C:
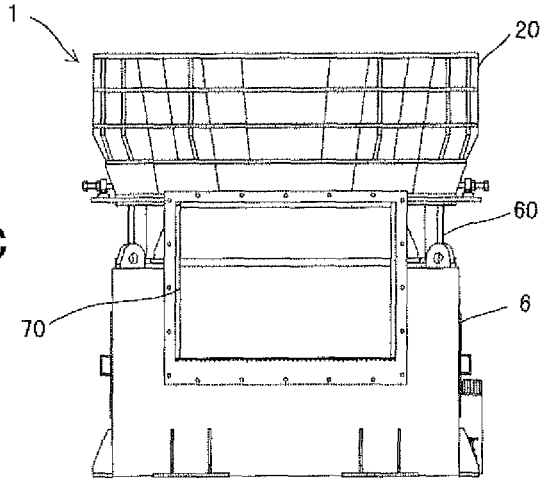
FIG. 2C is a left side view of the vertical shredder.

As illustrated in FIG. 2A, FIG. 2B, and FIG. 2C, a vertical shredder 1 is a device that performs a shredding process on a household electric appliance such as a refrigerator, and includes a motor 4 provided to a device frame 6 and a shredding process unit 10. The shredding process unit 10 includes components such as: a discharge ring 60 fixed to the device frame 6; a cylindrical shell 20 disposed above the discharge ring 60; and a breaker 30 rotatably accommodated in the cylindrical shell 20. A shredded material by the shredding process unit 10 is swept out through a discharge portion 70.

In the device frame 6, a pulley 3 attached to an output shaft 4A of the motor 4, is coupled to a pulley provided to a rotation shaft 2 of the shredding process unit 10 via a V belt 5 in a driving force transmittable manner. Thus, a rotor 40 is rotated relative to the cylindrical shell 20 by driving force from the motor 4. The rotation shaft can rotate in normal and reverse directions, through rotation of the motor 4 in the normal and reverse directions.

Figure 1A:
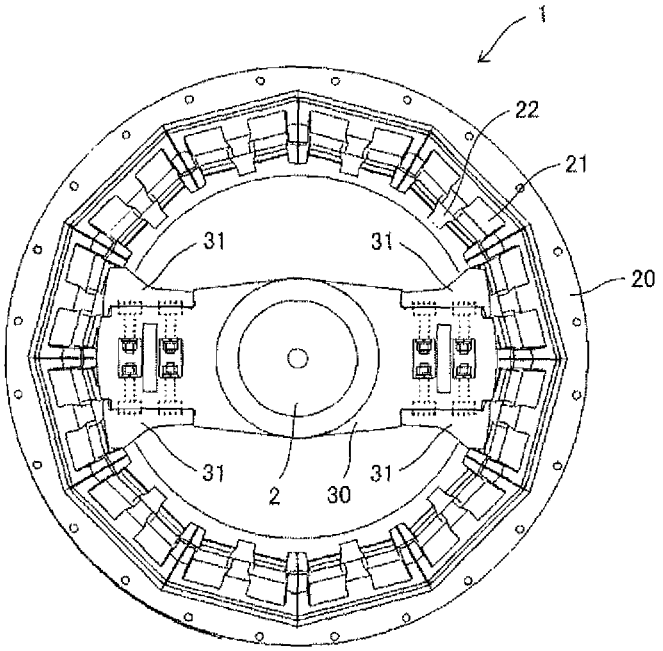
FIG. 1A is a plan view of a main portion of a vertical shredder.
Figure 1B:
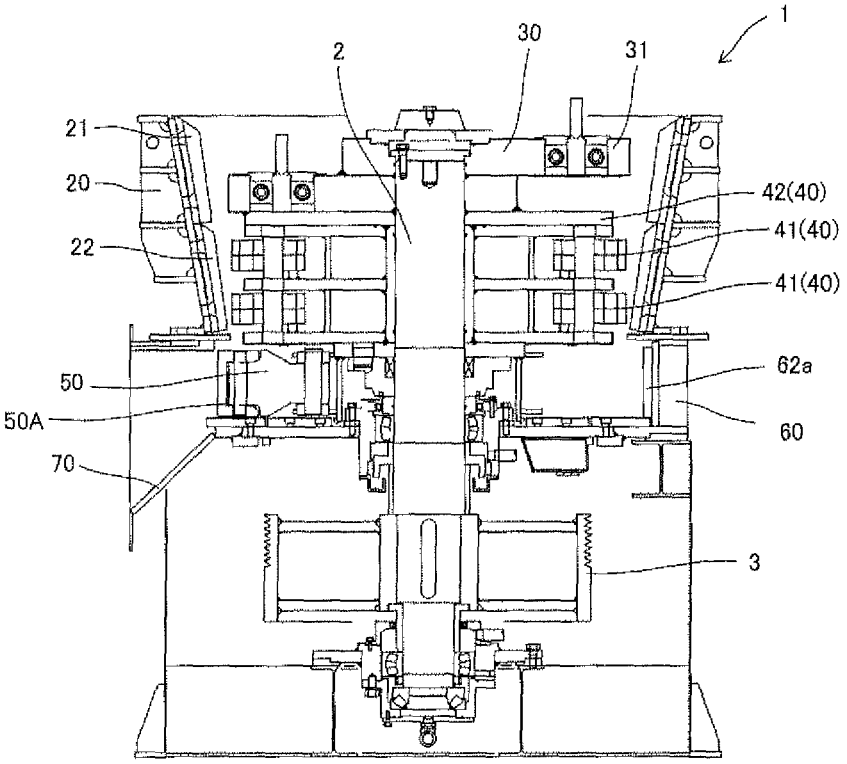
FIG. 1B is a longitudinal cross-sectional view of the vertical shredder.

As illustrated in FIG. 1A and FIG. 1B, the cylindrical shell 20 has an inner circumference portion provided with upper and lower shell liners 21 and 22 on which ribs are formed to extend vertically. The breaker 30, the rotor 40, and a sweeper 50, on the inner side of the cylindrical shell 20, are supported by the rotation shaft 2 in such a manner as to be integrally rotatable about a vertical axis, and are arranged in this order from the upper side. Specifically, a cross section of the cylindrical shell 20 is formed into polygonal or circular, and the overall shape of the cylindrical shell 20 is formed to be tubular. A diameter of the cylindrical part is gradually shrunk from the upper end to the lower end. The cross section of the cylindrical shell 20 is formed into regular dodecagon in this embodiment. However, the shape is not limited to regular dodecagon. The rotor 40 includes: a disk 42; and a plurality of shredding grinders 41, serving as a shredding mechanism, supported on outer circumference portions of the disk 42 in such a manner as to be freely rotatable. The shredding mechanism is not limited to the shredding grinders 41, and may employ any other known configuration.

The shredding target object put in from the upper side is smashed and shredded by the breaker 30, and is then conveyed downward while being shredded between the shell liners 21 and 22 and the shredding grinders 41 into small pieces to fall into the discharge ring 60 disposed on a lower side of the cylindrical shell 20.

The shredded material fell into discharge ring 60 is swept out through an opening 50A formed on a circumference wall of the discharge ring, by a sweeping operation performed by the sweeper 50 by rotating about the rotation shaft 2, to be discharged to the outside through the discharge portion 70.

Figure 3C:
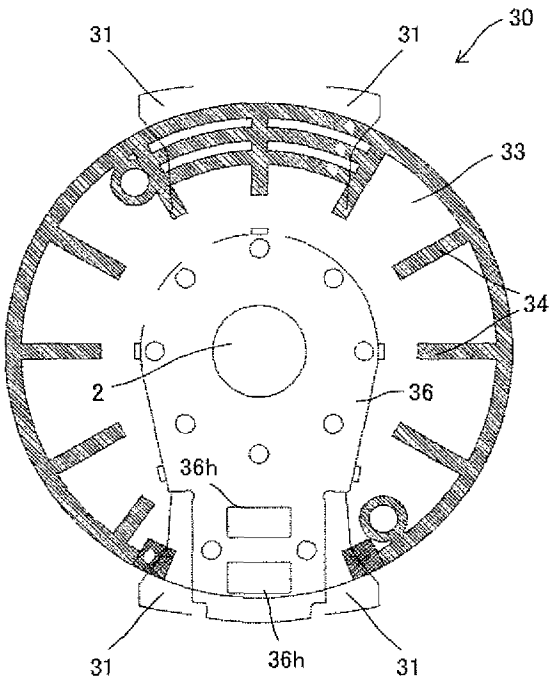
FIG. 3C is a plan view of a main portion of the breaker.
Figure 3B:
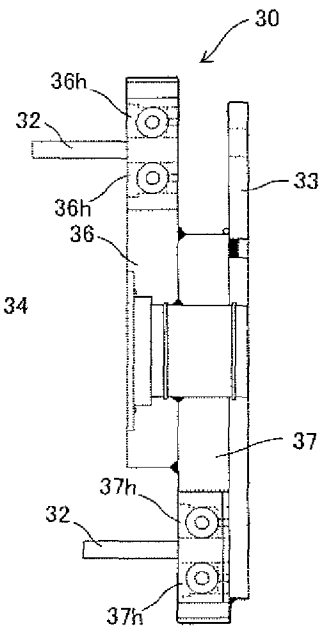
FIG. 3B is a right side view of the breaker.
Figure 3A:
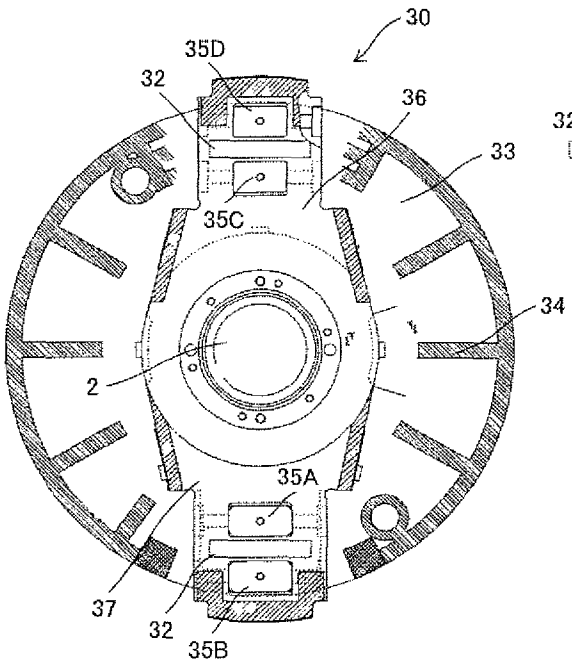
FIG. 3A is a plan view of a breaker.
Figure 4A:
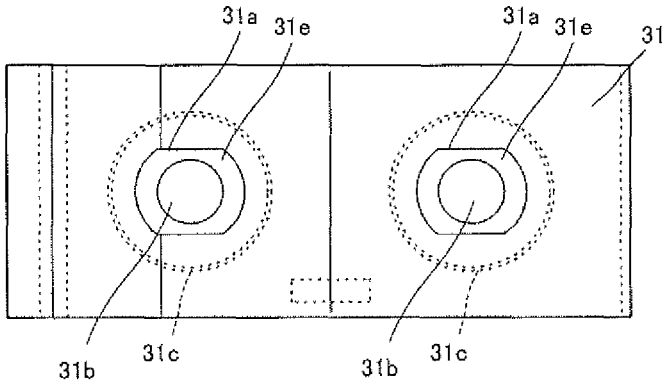
FIG. 4A is a plan view of a breaker liner.
Figure 4B:
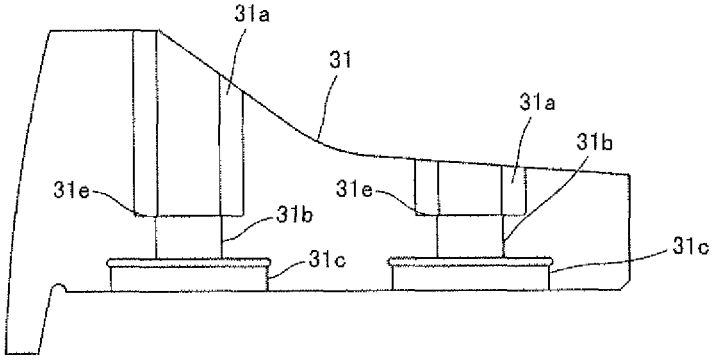
FIG. 4B is a front cross-sectional view of the breaker liner.
Figure 4C:
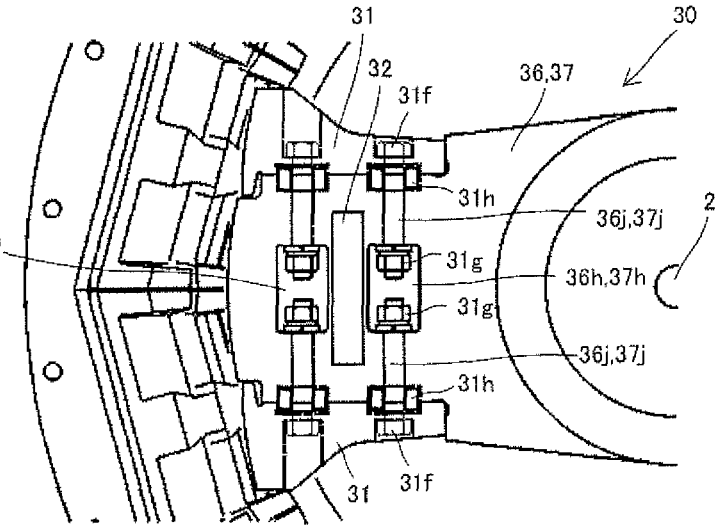
FIG. 4C is a diagram illustrating a main portion in a state where the breaker liner is attached.

As illustrated in FIG. 3A, FIG. 3B, and FIG. 3C, the breaker 30 includes: a base 33 having a disk shape inserted in the rotation shaft 2 and integrally rotates with the rotation shaft 2; and first arm member 36 and second arm member 37 that are disposed on the upper side of the base 33. The first arm member 36 and the second arm member 37 are each formed to extend in a radial direction of the base 33, in such a manner as to be at 180° relative to each other. The first arm member 36 is disposed more on the upper side than the base 33 in an axis direction by a distance corresponding to the thickness of the second arm member 37.

The shredding target object thrown in the cylindrical shell 20 is smashed and shredded by the first arm member 36 and the second arm member 37 that rotate together with the base 33 about the rotation shaft 2. The shredding target object is conveyed on the base 33 to be guided between the shell liners 21 and 22 and the shredding grinder 41. The base 33 is prevented from wearing in this process with raised portions 34 in a radial form provided on its upper surface. Hatched portions in FIG. 3A and FIG. 3C represent the raised portions 34.

Breaker liners 31 are attached to tips of the first arm member 36 and the second arm member 37 of the breaker 30 to prevent wearing as a result of smashing the shredding target object.

The attachment structure for the breaker liner 31 is described below.

As illustrated in FIG. 3A, FIG. 3B, FIG. 3C, FIG. 4A, FIG. 4B, and FIG. 4C, at least areas of the breakers 30 (36, 37) between the left and right breaker liners 31 are each provided with a corresponding one of pairs of through holes 36*h* and 37*h* formed to extend in the radial direction. Each of the through holes 36*h* and 37*h* has an inner wall on which a corresponding one of bolt insertion holes 36*j* and 37*j* is formed to extend toward the side surface of the breakers 30 (36, 37).

The through holes 36*h* and 37*h* each serve as a void formed to have an opening on the upper side. This configuration where the void is the through hole should not be construed in a limiting sense, and a configuration where the void is a recessed portion having an opening on the upper side and a bottom portion may be employed.

Bolts 31*f* are inserted into the bolt insertion holes 36*j* and 37*j* through attachment holes 31*b* formed on the breaker liners 31. The bolts 31*f* are fastened by using nuts 31*g* from the inner wall side of the through holes 36*h* and 37*h*.

Thus, no long bolt needs to be used and the elongation of the bolt due to the impact and the like as a result of smashing the shredding target object can be prevented, whereby loosening of the nut can be prevented. The shredding target object never comes into contact with the nuts 31*g*, regardless of whether the breaker is rotating in the normal or reverse direction. Thus, the wearing of the nuts 31*g*, rendering them difficult to remove, is prevented.

The through holes 36*h* and 37*h* are preferably formed in a center portion of the breaker 30 in a width direction extending left and right. With this configuration, the both left and right side surfaces of the breakers 30 (36, 37) can be at an equal distance from the center portion where the through holes 36*h* and 37*h* are provided. The bolts 31*f* of equal lengths can be used for attaching the left and right breaker liners 31. The weight balance of the breaker liners 31 is symmetrical on left and right sides, whereby a stable operation can be achieved with rotation in both the normal and the reverse directions.

A counter bore portion 31*a* is formed around each attachment hole 31*b* formed in the breaker liner 31. The counter bore portion 31 a accommodates a head portion of the bolt 31*f* in a rotation prevented state. Facing surfaces 31*e* of the counter bore portion 31*a* and the head portion of the bolt 31*f* are provided with surface finishing to be smooth surfaces.

As described above, the facing surfaces 31 e of both the counter bore portion 31*a* and the head portion of the bolt 31*f* are provided with the surface finishing to be smooth surfaces. As a result, the facing surfaces are not largely deformed by the smashing of the shredding target object after the initial fastening fixing. Thus, the fastened state can be prevented from being loosened, whereby no additional fastening work is required.

If the facing surface 31*e* of any one of the counter bore portion 31*a* and the head portion of the bolt 31*f* is formed as a rough surface, recesses and protrusion on the rough surface plastically deform to be flat as a result of smashing the shredding target object after the initial fastening fixing. As a result, a gap is formed between the facing surfaces 31*e*, and thus the additional fastening work is required.

Counter bore portions (for example, counter bore portions 31*c* on a side of the attachment holes 31*b* are illustrated) are formed in areas facing the attachment holes 31*b*, formed in the breaker liner 31, and the bolt insertion holes 36*j*, 37*j*, formed in the breaker 30 (36, 37). Spaces formed by the counter bore portions each accommodate a collar member 31*h* having a cylindrical shape. The collar member 31*h* receives a shearing load acting on the bolt 31*f* due to the impact received as a result of smashing the shredding target object. Thus, displacement between the breaker liner 31 and the breaker 30 (36, 37) is prevented. A pair of upper and lower lids 35A and 35B and a pair of upper and lower lids 35C and 35D are further provided to close the through holes 36*h* and 37*h*. The rotation balance of the breakers 30 (36, 37) can be adjusted with the weight of the lids 35A, 35B, 35C, and 35D.

After the breaker liners 31 are attached, the through holes 36*h* and 37*h* are closed with the lids 35A, 35B, 35C, and 35D. Thus, the shredded material after the shredding process is prevented from entering and clogging the through holes 36*h* and 37*h*. The stable rotation can be achieved with the lids 35A, 35B, 35C, and 35D serving as the balance weights for adjusting the balance of the breakers 30 (36, 37) in rotation.

As illustrated in FIG. 1B, the discharge ring 60 is disposed to surround the sweeper 50. The sweeper 50 performs the sweeping operation by rotating about the rotation shaft 2, whereby the shredded material is swept out through the opening 50A formed on the circumference wall of the discharge ring 60. Discharge ring liners 62*a* are disposed on the inner circumference portion of the discharge ring 60, to prevent the discharge ring 60 from wearing.

Figure 5A:
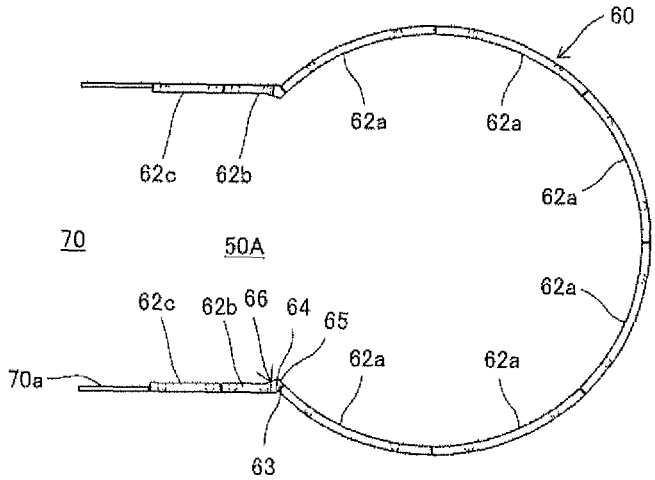
FIG. 5A is a plan view of a discharge ring liner and a discharge portion liner.
Figure 5B:
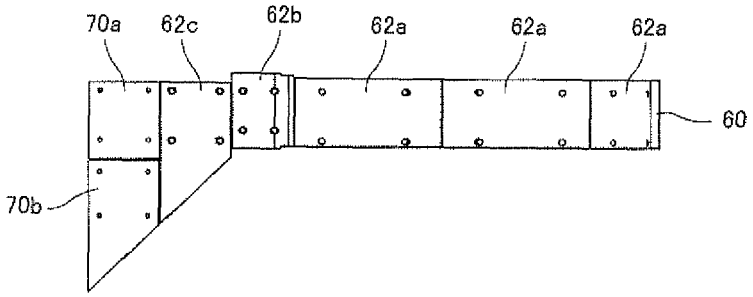
FIG. 5B is a plan view of the discharge ring liner and the discharge portion liner.

As illustrated in FIG. 5A and FIG. 5B, discharge portion liners 62*b* are attached to be in such a manner as to protrude from the discharge portion side toward a side of the discharge ring 60, and cover edge portions 63 of the discharge ring liners 62*a* on a side of the opening 50A.

The edge portions 63 of the discharge ring liners 62*a* positioned on the side of the opening 50A are covered with the discharge portion liners 62*b*. Thus, when the is shredded material swept out through the opening 50A, the discharge portion liners 62*b* wear instead of the edge portions 63 of the discharge ring liners 62*a*. As a result, the discharge ring liners 62*a* requiring a cumbersome work to be replaced are prevented from wearing. The discharge portion liners 62*b* are disposed outside the discharge ring 60 and on a side of the discharge portion 70, and thus can be easily replaced.

Each of the discharge portion liners 62*b* includes: a facing edge portion 64 facing the edge portion 63 of the discharge ring liner 62*a* on the side of the opening 50A; and a thick portion 66 disposed adjacent to the facing edge portion 64 and having a surface 65 that continues from a surface of the discharge ring liner 62*a* with the same curvature.

With this configuration, the shredded material guided to the opening 50A along the surface of the discharge ring liner 62*a* by the sweeping operation of the sweeper 50 is finally swept out in the radial direction of the discharge ring 60 while being in contact with the surface 65 of the thick portion 66 of the discharge portion liner 62*b*. This means that the portion to be most heavily worn is thick, and thus the maintenance does not need to be frequently performed.

Figure 6A:
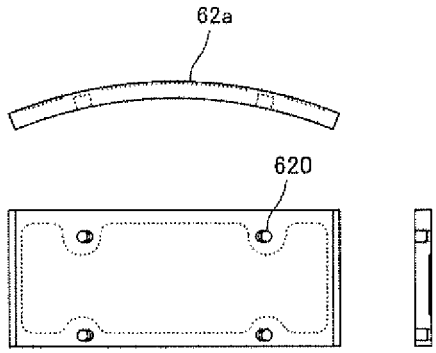
FIG. 6A is a diagram illustrating the discharge ring liner.
Figure 6B:
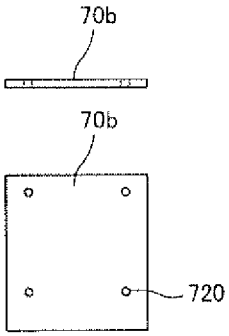
FIG. 6B is a diagram illustrating the discharge portion liner.
Figure 6C:
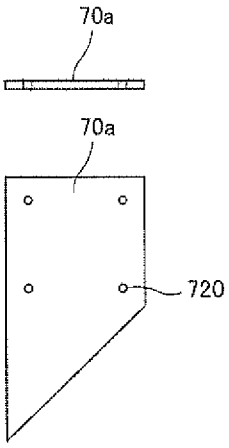
FIG. 6C is a diagram illustrating the discharge portion liner.
Figure 6D:
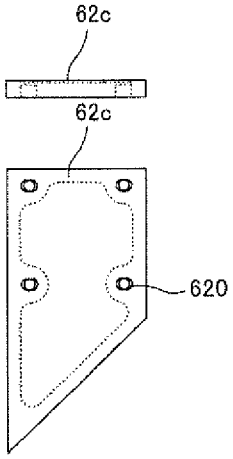
FIG. 6D is a diagram illustrating the discharge portion liner.

FIG. 6A illustrates a structure of each of the discharge ring liners 62*a*, attached to the discharge ring 60 via upper and lower attachment holes 620, as viewed from front, above, and side. FIG. 6B to FIG. 6D respectively illustrate structures of discharge portion liners 62*c*, 70*a*, and 70*b*, illustrated in FIG. 5B, as viewed from front and above. The discharge portion liners 62*c*, 70*a*, and 70*b* are each attached to the side wall of the discharge portion 70 via the upper and lower attachment holes 620.

Figure 6E:
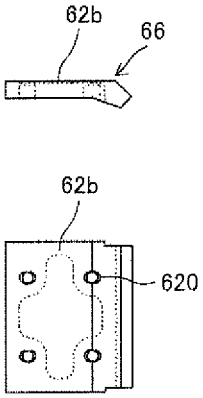
FIG. 6E is a diagram illustrating the discharge portion liner.
Figure 6F:
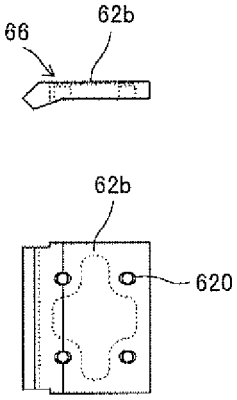
FIG. 6F is a diagram illustrating the discharge portion liner.

As illustrated in FIG. 6E and FIG. 6F, the discharge portion liner 62*b* according to the present invention can be attached to both left and right sides of the opening 50A by being flipped upside down. The same discharge portion liner 62*b* can be attached to both left and right sides of the opening 50A. Thus, the common parts can be used, and the liners on the left and right sides of the opening 50A can be flipped upside down and attached when there is uneven wearing between upper and lower sides. Thus, an attempt to reduce cost can be effectively facilitated.

When the angle between the left and right edges of the opening 50A about the rotation shaft 2 is less than 180° as in the embodiment described above, no support mechanism needs to be additionally provided for supporting the cylindrical shell 20 disposed above the discharge ring 60. Thus, the vertical shredder 1 can have a simple structure with a compact discharge portion.

The embodiment described above is merely an example of the present invention. It is a matter of course that the specific structure, shape, size and the like of each of the components may be designed to be different as long as the advantageous effects of the present invention can be achieved.

DESCRIPTION OF SYMBOLS

1: vertical shredder
20: tubular shell
21, 22: shell liner
30: breaker
31: breaker liner
40: rotor
50: sweeper
50A: opening
60: discharge ring
62*a*: discharge ring liner
62*b*: discharge portion liner
70: discharge portion

What is claimed is:

1. A breaker liner attachment and breaker structure for a vertical shredder having: (i) a rotor that is supported on a rotation shaft rotating about a vertical axis and includes a shredding mechanism, (ii) and a tubular shell that is disposed on an outer side of the rotor in a radial direction in such a manner as to be concentric with the vertical axis, the breaker liner attachment and breaker structure comprising:

a breaker that is supported by the rotation shaft above the rotor, at least a pair of breaker liners disposed opposite to each other on both sides of the breaker, a void or a through-hole having an opening provided on an upper side of the breaker between the pair of breaker liners, bolt insertion holes provided in the breaker and being communicable with inner walls of the void or the through-hole to side surfaces of the breaker, and bolts that are inserted into the bolt insertion holes via attachment holes formed in the pair of breaker liners, the bolts being fastened with nuts from a side of the inner walls of the void or the through-hole so that the nuts are inside the void or the through-hole, and a lid configured to cover the void or the through-hole.

2. The breaker liner attachment and breaker structure according to claim 1, wherein the void or the through-hole is formed in a center portion of the breaker in a width direction.

3. The breaker liner attachment and breaker structure according to claim 2, wherein the lid is configured to operate as a balance weight for adjusting a rotation balance of the breaker.

4. The breaker liner attachment and breaker structure according to claim 1, wherein a counter bore portion is provided on each of the attachment holes formed in the breaker liners, the counter bore portion being configured to accommodate a head portion of a corresponding one of the bolts, and facing surfaces of the counter bore portion and the head portion of the bolt are provided with surface finishing that is smooth.

5. The breaker liner attachment and breaker structure according to claim 4, wherein the lid is configured to operate as a balance weight for adjusting a rotation balance of the breaker.

6. The breaker liner attachment and breaker structure according to claim 1, wherein the lid is configured to operate as a balance weight for adjusting a rotation balance of the breaker.

* * * * *